United States Patent [19]

Bender

[11] 4,328,002

[45] May 4, 1982

[54] METHODS OF TREATING COAL TO REMOVE SULFUR AND ASH

[76] Inventor: Robert Bender, 325 Castlegate Rd., Pittsburgh, Pa. 15221

[21] Appl. No.: 273,912

[22] Filed: Jun. 15, 1981

[51] Int. Cl.[3] ..... C10L 9/06

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 4,083,940 | 4/1978 | Das | 44/1 R |
| 4,097,244 | 6/1978 | Burk, Jr. et al. | 201/17 |
| 4,197,090 | 4/1980 | Yoo et al. | 201/17 |
| 4,256,464 | 5/1981 | Ray | 44/1 SR |

*Primary Examiner*—Carl F. Dees

*Assistant Examiner*—Margaret B. Medley

*Attorney, Agent, or Firm*—Buell, Blenko, Ziesenheim & Beck

[57] ABSTRACT

Methods of treating coal to remove sulfur and ash are provided which involve the steps of preconditioning coal particles in the presence of an aqueous solution of an oxidizing agent, washing said pretreated coal with water, contacting said coal with an aqueous solution of an oxidizing agent until an exothermic reaction between the coal and oxidizing agent peaks and the pH drops to the range of 2 to 3, removing the coal from the oxidizing agent, contacting the coal with a passivating agent until the temperature of the coal drops and the pH rises into the range 3 to 5, neutralizing the coal up to a pH of about 9, washing said coal with water and drying said coal.

11 Claims, No Drawings

METHODS OF TREATING COAL TO REMOVE SULFUR AND ASH

This invention relates to methods of treating coal to remove sulfur and ash and particularly to methods of treating coal chemically in aqueous suspension to remove a major portion of both inorganic and organic sulfur and convert the same to useful by-products.

Eastern or Appalachian coals vary considerably in their sulfur content but can contain as much as 6–8% by weight of total sulfur as compared to commercial Western coals which normally have 1% sulfur or less. Recent E.P.A. standards for coal burning in stationary plants sets the level of $SO_2$ emission permitted per million BTU's of hot input at only 1.2 lbs. of $SO_2$. This translates into less than 1.5% total sulfur permissable in the average Eastern coal mined in Pennsylvania, Maryland, Ohio or West Virginia. This low value makes the burning of Eastern coals less practical in most stationary plants.

As mentioned above, sulfur in coal can be broadly classed as either inorganic (mineral) and organic. The term pyritic is frequently used interchangeably for inorganic sulfur because the inorganic sulfur frequently appears as pyrites (iron sulfide) in coal. Inorganic sulfur comprises between 25% to 75% of the total sulfur content of Eastern coals.

A very extensive technology has developed in methods for extracting sulfur in coal and a very substantial patent literature exists in this field. The claims of prior art technicians vary from methods aserted to remove all inorganic sulfur and some organic sulfur to claims for removing a portion of each. The primary problem which has remained unsolved is not only the chemical extraction of the maximum amount of sulfur from within the coal but its physical removal from the coal particles and, secondarily, its transformation into a useful and salable by-product.

The methods of sulfur removal proposed by the prior art do not provide for the creation of a useful by-product from the sulfur removed from the coal and, in addition, have many drawbacks which have retarded or restricted their commercial adoption. For example many prior art processes require expensive external applications of heat and/or pressure, even requiring the formation of a char by heating to elevated temperatures. Other methods involve expensive and sophisticated chemical reagents and equipment which makes them economically non-viable in todays marketplace. In many cases environmental disposal problems occur in the coal treatment process.

In the present invention all of the foregoing problems are eliminated. In the process of this invention inexpensive, easily purchased commercial reagents are employed, no external applications of heat are required, no external applications of pressure are required, adverse environmental problems are eliminated, useful agricultural by-products are produced and the process steps are rapid, easily controlled, and effective.

By the process of the present invention, removal of sulfur (inorganic and organic) has been effective to a level of more than 67% of the original sulfur content, accompanied by over 75% ash reductions. Heat content (BTU) of the coal is enhanced in most cases. For example in one coal processed by this invention the BTU value was increased over 21%. Depending upon the original coal sulfur content, the total sulfur of the processed coal has been brought below 1.5% in most coals, and it is believed that the sulfur value can be brought below 1% consistently.

The reactions in the process of this invention are exothermic and the chemical reactions can be readily controlled by maintaining this exothermic heat output within certain temperature ceilings. This can be done by pH control, by cold water quenching the reactants and by other means which will be apparent to a skilled technician in this field. The chemical procedures are safe, simple and readily controlled.

In the process of the present invention coal is cleaned by one of the conventionally accepted methods to remove rock, wood, shale, and other non-coal debris and then mechanically reduced in size. The cleaned coal is then pretreated with an aqueous suspension of an oxidant, preferably, but not necessarily combined with a surfactant or detergent, washed with water and then immediately immersed in or sprayed with the oxidant and detergent solution. A reaction occurs immediately and peaks exothermically within 1 or 2 minutes. The treated coal is removed from the oxidant detergent solution and sprayed with a passivating sequestering reagent. The coal loses heat rapidly and the pH climbs into the 3 to 5 range from a bottom pH of 2 to 3. The coal is neutralized with a basic reagent spray up to a pH of about 9, washed, deactivated and dried. The preferred oxidants for the present process are $H_2O_2$, $HNO_3$, $HClO_4$, HF, $O_2$, air and mild $NH_3$ or $CO_2$ as well as mixtures of those reagents in 5–40% by weight concentration. The passivating, sequestering agent is preferably from one of the groups carbon dioxide, carbon monoxide, carbonic acids, dicarboxylic acids, ketones, aldehydes, alcohols, diols, polyols, amino polycarboxylic acids $NH_4OH$, ammonium salts, and amines, in aqueous concentrations of 1% to 40%. The neutralization of the coal following reaction is preferably accomplished by alkali metal hydroxide solutions, alkaline earth metal hydroxides, ammonium hydroxide, ammonium salts and similar alkaline materials whose sulfur product are usable as agricultural materials. The preferred concentration of the neutralizing agent is 1 to 10% by weight in the total aqueous solution. A surfactant or surface active agent can be used, if desired, in the wash waters of the system.

The steps of the process may be summarized as follows:

(1) The coal is preconditioned or sensitized in a soak for 5 minutes in the oxidizing agent/detergent solution.

(2) The coal is then washed in water.

(3) The coal is immediately immersed or sprayed with the oxidizing reagent/detergent solution. The reaction peaks exothermically within 1 to 2 minutes. The pH of the mother liquor/decantate begins in the neutral to slightly basic range (pH 7–8) but rapidly drops as the oxidation proceeds, down to a pH of 2 to 3. In some instances, the temperature can peak as high as 120° F. above the ambient temperature.

(4) The passivating/sequestering reagent is then sprayed onto the coal and the temperature drops rapidly and the pH climbs into the 3 to 5 range. This step requires one to two minutes.

(5) The coal is then neutralized with a basic reagent spray up to a pH of 9. Total time necessary is one to two minutes.

(6) The coal is washed with water for one minute.

(7) Steps (3) to (6) are repeated for a total of three to four cycles, depending on the original sulfur content of the coal.

The foregoing steps are illustrated in the accompanying drawing showing a flow sheet of the process of this invention in a presently preferred embodiment.

In the foregoing description, the invention has been generally outlined, however, it will be more clearly understood by reference to the following examples showing the practice of this invention on a laboratory and pilot scale.

In all of the following examples ash, sulfur and heat content values are based on the corrected "dry" percent by weight analyses rather than the "as received" sample. All reagent concentrations are also given as percent by weight.

EXAMPLE I

| | Coal analyses: | | |
|---|---|---|---|
| | Original % "dry" | Processed % "dry" | % Change (+) = increase (−) = decrease |
| Ash | 33.27 | 29.44 | (−) 11.5 |
| Sulfur (total) | 5.38 | 2.41 | (−) 55.2 |
| BTU/lb. | 9,215 | 9,978 | (+) 8.3 |

Twenty grams of a West Virginia, Chessie-Tyson seam coal, ground to 200 mesh, was preconditioned with a 6% $H_2O_2$/wetting agent solution for five minutes. The coal was then washed with water and treated with a 30% $H_2O_2$ solution for about five minutes. A 10% NaOH rinse was followed by another water wash. In the second and third cycles, the primary oxidants were 10% $HNO_3$ solution and a combination of 50/50 30% $H_2O_2$ and 10% HCl. The final neutralization was treatment with 5% $NH_4OH$. The coal was then washed and dried for the ensuing analyses.

EXAMPLE II

| | Coal analyses: | | |
|---|---|---|---|
| | Original % "dry" | Processed % "dry" | % Change (+) = increase (−) = decrease |
| Ash | 13.18 | 11.26 | (−) 14.6 |
| Sulfur (total) | 2.81 | 1.26 | (−) 55.2 |
| BTU/lb. | 13,475 | 13,551 | (+) 0.6 |

Twenty grams of a Pennsylvania, Bakertown seam coal, $\frac{3}{4}\times 0$ grind, was sprayed with a 5% $NH_4OH$ and detergent solution, followed by treatment with 10% $H_2O_2$ solution. After the five minute preconditioning, the coal was washed with water. The coal was then sprayed with a 10% $H_2O_2$ solution and then reacted with a 5% $NH_4OH$ solution. The coal was then washed with water. This cycle of oxidation/neutralization and pasivation/water washing required two to three minutes. The cycle was repeated for a total of four sequences. The coal was dried and analyzed.

EXAMPLE III

| | Coal analyses: | | |
|---|---|---|---|
| | Original % "dry" | Processed % "dry" | % Change (+) = increase (−) = decrease |
| Ash | 10.51 | 9.22 | (−) 12.3 |
| Sulfur (total) | 3.34 | 1.56 | (−) 53.3 |
| BTU/lb. | 13,832 | 14,229 | (+) 2.9 |

Thirty grams of a Maryland coal of the Franklin or Little Pittsburgh seam was ground to $\frac{3}{8}\times 0$ mesh and preconditioned as in Examples I and II, with 30% $H_2O_2$. After water washing, three, three-to-four minute cycles of: (a) 30% $H_2O_2$ reaction, (b) 10% Cellosolove (ethylene glycol monethyl ether)treatment, (c) 10% $NH_4OH$ rinsing and (d) final water washing, were accomplished. The coal was dried and analyzed.

EXAMPLE IV

| | Coal analyses: | | |
|---|---|---|---|
| | Original % "dry" | Processed % "dry" | % Change (+) = increase (−) = decrease |
| Ash | 15.61 | 4.18 | (−) 73.2 |
| Sulfur (total) | 2.60 | 0.84 | (−) 67.3 |
| BTU/lb. | 12,233 | 14,755 | (+) 20.6 |

Fifty pounds of a West Virginia, Bakertown seam coal, ground to $\frac{3}{8}\times 0$ mesh, was preconditioned as in the prior Examples with 25% $H_2O_2$. After water washing, two cycles of three minutes each included the treatments: (a) 25% $H_2O_2$ and detergent solution, (b) oxalic acid (solution pH adjusted to 1.4) and (c) water washing. A neutralization wash with 10% $NH_4OH$, after the last cycle, was followed by final water washing. The coal was dried for ensuing analyses.

In the foregoing specification, certain preferred practices and embodiments of this invention have been set out, however, it will be understood that this invention may be otherwise embodied within the scope of the following claims.

I claim:

1. A process for treating coal to reduce the sulfur and ash content and produce a usable by-product from said sulfur and ash comprising the steps of:
   a. preconditioning coal particles in the pressence of an aqueous solution of an oxidizing agent,
   b. washing said pretreated coal with water,
   c. contacting said coal with an aqueous solution of an oxidizing agent until an exothermic reaction between the coal and oxidizing agent peaks and the pH drops to the range of 2 to 3,
   d. removing the coal from the oxidizing agent,
   e. contacting the coal with a passivating agent until the temperature of the coal drops and the pH rises into the range 3 to 5,
   f. neutralizing the coal up to a pH of about 9,
   g. washing said coal with water, and
   h. drying said coal.

2. A process as claimed claim 1 wherein the neutralized reaction products of sulfur are recovered.

3. A process as claimed in claim 1 or 2 wherein the coal particles are preconditioned by soaking for about 5 minutes in oxidizing agent.

4. A process as claimed in claim 3 wherein the oxidizing agent is one or more members selected from the group consisting of $H_2O_2$, $HNO_3$, $NClO_4$, HF, $O_2$, air and $CO_2$.

5. A process as claimed in claim 3 wherein a surface active agent is added to the solution of oxidizing agent.

6. A process as claimed in claim 3 wherein the coal passivating agent is one or more members selected from the group consisting of carbon dioxide, carbon monoxide, carbonic acids, dicarboxylic acids, ketones, aldehydes, alcohols, diols, polyols, amino polycarboxylic acids and amines.

7. A process as claimed in claim 3 wherein the neutralizing agent is an aqueous solution of one or more members selected from the group consisting of alkali metal hydroxides, alkaline earth metal hydroxides, ammonium hydroxide, and ammonium salts.

8. A process as claimed in claim 3 wherein the oxidizing agent is present in a concentration of about 5% -40% by weight of solution.

9. A process as claimed in claim 3 wherein the passivating agent is present in a concentration of about 1% to 50% by weight of solution.

10. A process as claimed in claim 3 wherein the neutralizing agent is present in a concentration of about 1% to 10% by weight of the total aqueous solution.

11. A process as claimed in claim 5 wherein the surface active agent is a member from the group consisting of cationic, anionic or non-ionic surfactants in a concentrations of about 0.01% to 1.0% by weight of oxidizing reagent.

* * * * *

UNITED STATES PATENT AND TRADEMARK OFFICE

CERTIFICATE OF CORRECTION

PATENT NO. : 4,328,002

DATED : May 4, 1982

INVENTOR(S) : ROBERT BENDER

It is certified that error appears in the above-identified patent and that said Letters Patent are hereby corrected as shown below:

Claim 1, column 4, line 52, "pressence" should be --presence--.

Claim 2, column 4, line 67, after "claimed" insert --in--.

Claim 4, column 5, line 6, "$NClO_4$" should be --$HClO_4$--.

Claim 9, column 6, line 8, "50%" should be --40%--.

Signed and Sealed this

Fourth Day of January 1983

[SEAL]

Attest:

GERALD J. MOSSINGHOFF

Attesting Officer

Commissioner of Patents and Trademarks